US005211527A

United States Patent [19]

Ahlsén et al.

[11] Patent Number: 5,211,527

[45] Date of Patent: May 18, 1993

[54] LOAD-HANDLING DEVICE

[75] Inventors: John B. B. Ahlsén, Angered; Kurt J. Dahlström, Partille, both of Sweden

[73] Assignee: Lift and Go Products Aktiebolag, Angered, Sweden

[21] Appl. No.: 752,352

[22] Filed: Sep. 3, 1991

[30] Foreign Application Priority Data

Sep. 4, 1990 [SE] Sweden ..... 9002824
Feb. 13, 1991 [SE] Sweden ..... 9100442

[51] Int. Cl.[5] ..... B66F 9/12

[52] U.S. Cl. ..... 414/664; 414/739; 414/631; 414/662; 414/668; 187/9 R

[58] Field of Search ..... 414/662, 663, 664, 668, 414/659, 660, 630, 631, 632, 749, 750, 751, 752, 753, 794.7; 187/9 R; 198/750

[56] References Cited

U.S. PATENT DOCUMENTS

| | | | |
|---|---|---|---|
| 2,677,471 | 5/1954 | Skinner | 414/630 |
| 3,029,957 | 4/1962 | Freeman et al. | 414/749 |
| 3,216,598 | 11/1965 | McKee et al. | 414/631 |
| 4,037,732 | 7/1977 | Orlando et al. | 414/662 |
| 4,613,126 | 9/1986 | Handa et al. | 198/750 X |
| 4,642,013 | 2/1987 | Mundus et al. | 414/752 X |

FOREIGN PATENT DOCUMENTS

| | | | |
|---|---|---|---|
| 0318823 | 11/1988 | European Pat. Off. . | |
| 1019968 | 11/1957 | Fed. Rep. of Germany . | |
| 1196124 | 7/1965 | Fed. Rep. of Germany . | |
| 1196571 | 7/1965 | Fed. Rep. of Germany . | |
| 2331985 | 1/1974 | Fed. Rep. of Germany | 414/631 |
| 2628514 | 1/1977 | Fed. Rep. of Germany | 414/749 |
| 2631948 | 12/1989 | France . | |
| 938435 | 10/1963 | United Kingdom . | |
| 1035896 | 7/1966 | United Kingdom | 414/749 |

*Primary Examiner*—Frank E. Werner
*Attorney, Agent, or Firm*—Beveridge, DeGrandi, Weilacher & Young

[57] ABSTRACT

A load-handling device is designed as a carriage movable along a floor and having a load-handling assembly whose load-engaging member is vertically movable as well as extendable and retractable relative to the carriage. According to the invention, the driving mechanism of the load-handling assembly comprises an endless driving element which runs along an elongate path between guiding wheels. The load-engaging member of the assembly is designed as a double-armed lever. The fulcrum of the lever is rotatably connected to the driving element so as to follow the movements thereof. One arm of the lever constitutes the load-engaging member or forms a part of the load-engaging member. The other arm of the lever has a cam follower. The cam follower serves to absorb torque produced by the load and, to this end, engages a cam track.

20 Claims, 7 Drawing Sheets

LOAD-HANDLING DEVICE

For handling goods and other loads, use is frequently made of so-called hand pallet trucks for lifting and moving pallets with different loads from one place to another on the floor.

Such lifting operations and transports are easily automated, but to date there has been a lack of inexpensive and simple load-handling devices which can be designed as automatic lifting trucks. As a result, it is an expensive business to install and maintain this type of system. Whether the lifting truck is automatically or manually operated, there is also a space problem. Thus, the passages in a warehouse must be sufficiently wide to allow the load-engaging members of the pallet trucks to be inserted under the load or brought into engagement therewith. In many cases, this necessitates wider warehouse passages than desirable with respect to an effective utilisation of the capacity of storage spaces.

EP-A-0,318,823 discloses a load-handling device whose load-engaging members are vertically movable as well as extendable and retractable relative to the carriage. The arrangement is such that the load-engaging members have a pair of rear wheels running on a lifting device, and a pair of front wheels which are engageable with the floor for the purpose of supporting the free end of the load-engaging members and take up the pressure of the load. Therefore, one drawback of this prior art device is that severe requirements must be placed as to the flatness and evenness of the floor to enable the pair of front wheels to roll freely.

DE-A-1,196,124 discloses a load-handling device which also comprises vertically movable as well as extendable and retractable load engaging members. In this known structure, the two movements, i.e. the lifting and lowering movement and the extending and retracting movement, are effected by two separate drive units, which makes the device complicated, expensive and rather bulky.

The object of the present invention therefore is to provide a load-handling device of a type having load-engaging members which are vertically movable as well as extendable and retractable relative to the carriage, with only one driving motor being required for the lifting and lowering and, respectively, the extending and retracting of the load engaging members.

According to the invention, this and other objects are achieved with the unique arrangement of the present invention.

Figure 1:
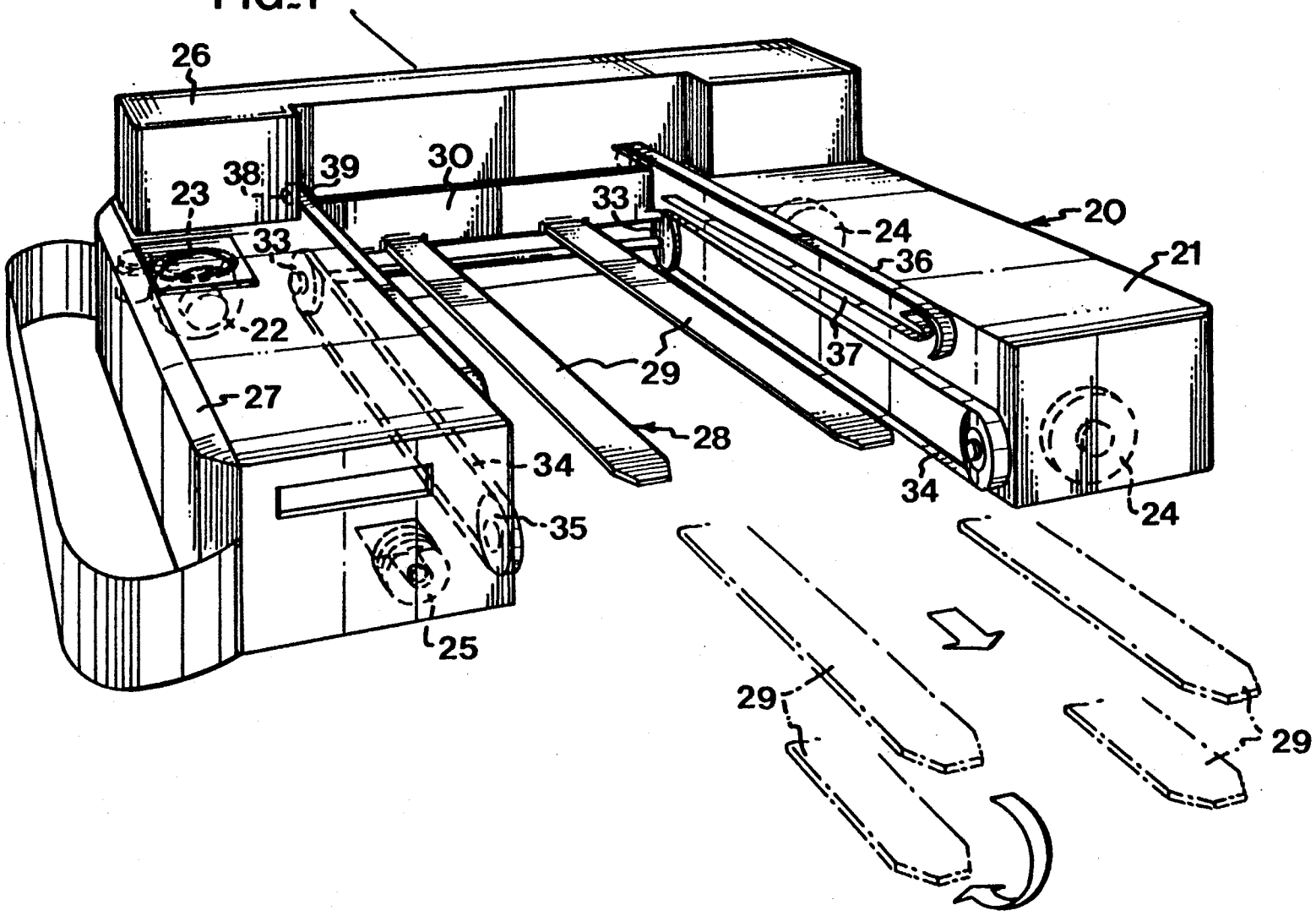
Figure 2:
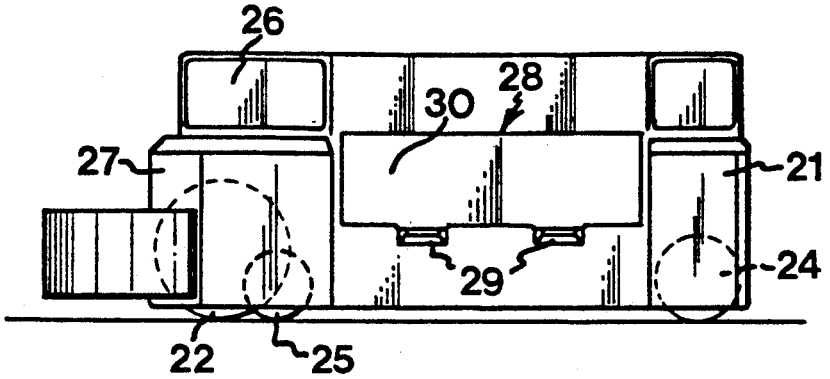
Figure 3:
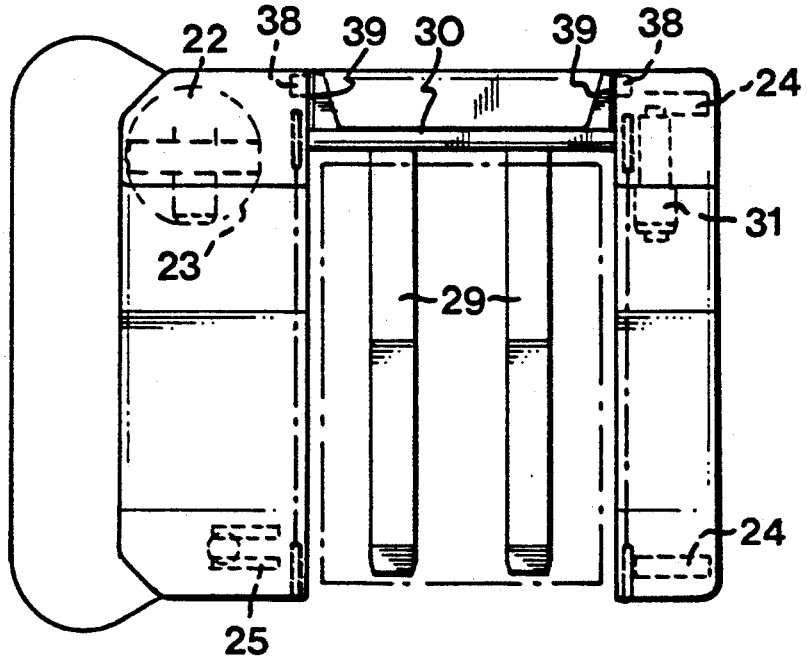
Figure 6:
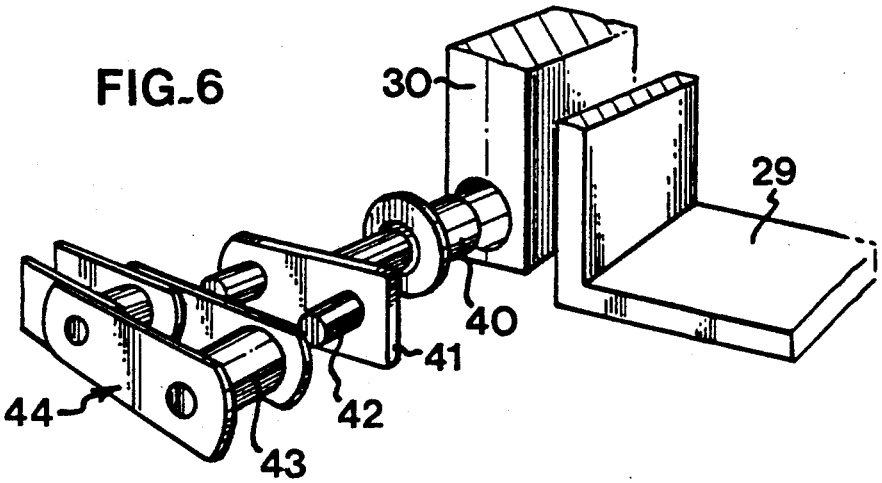
Figure 4:
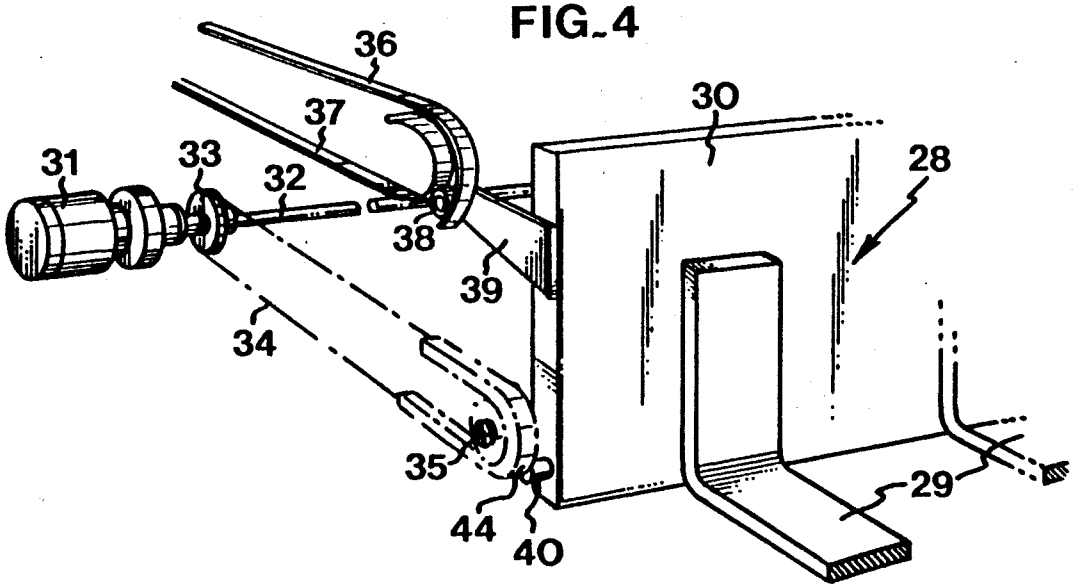
Figure 7:
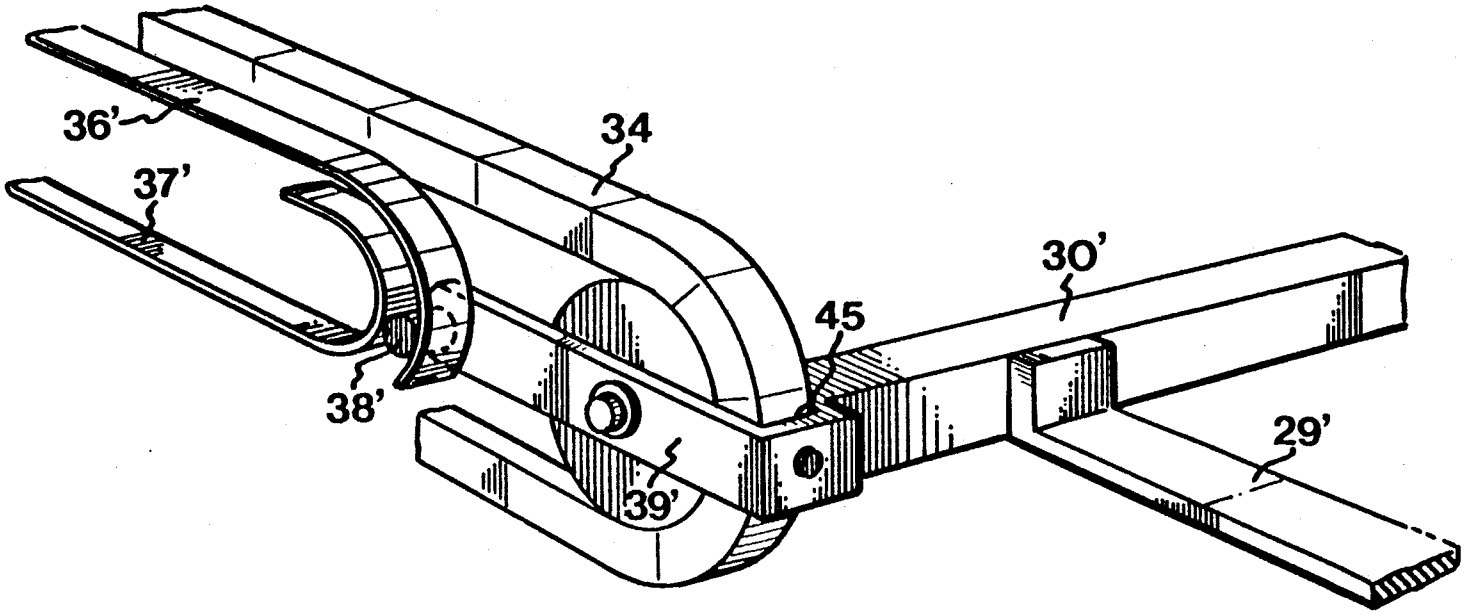
Figure 8:
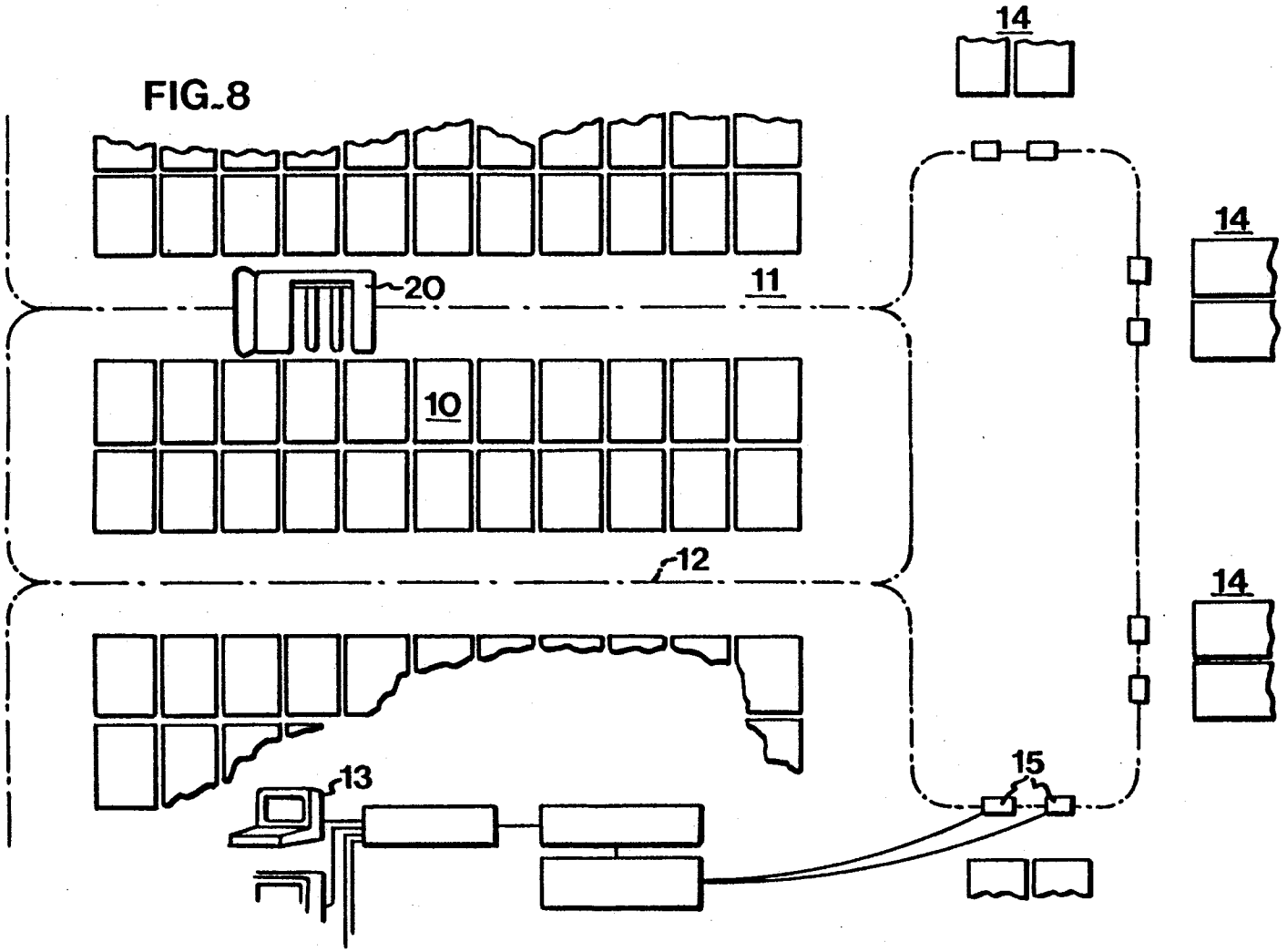
Figure 9:
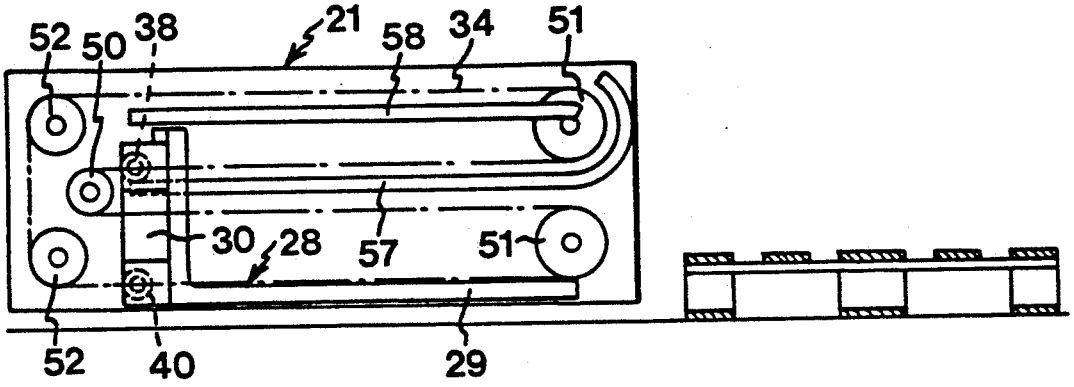
Figure 10:
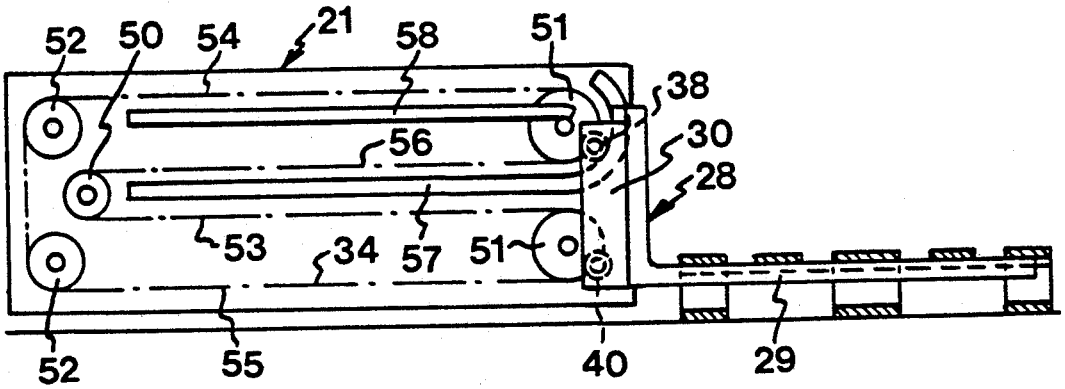
Figure 11:
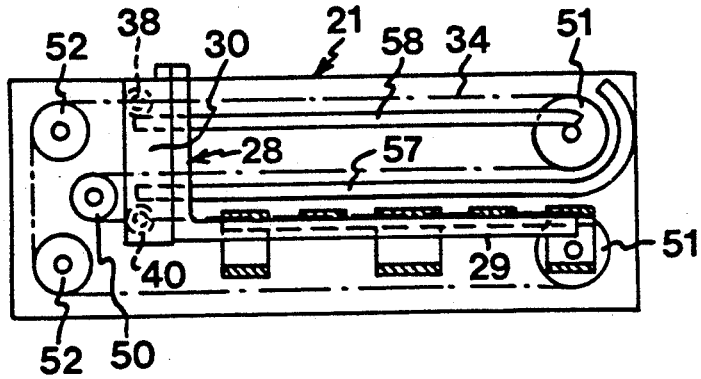
Figure 13:
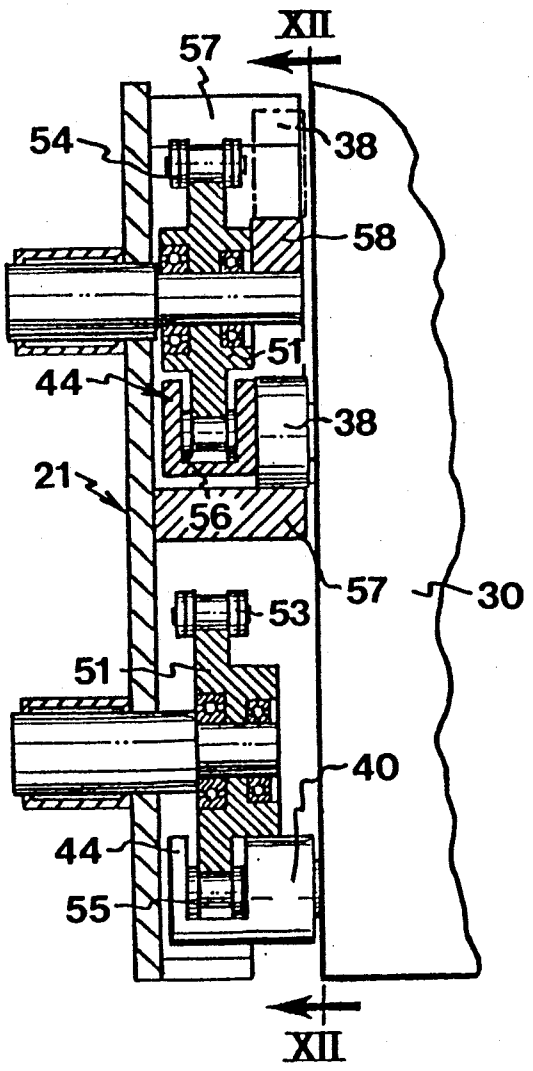
Figure 12:
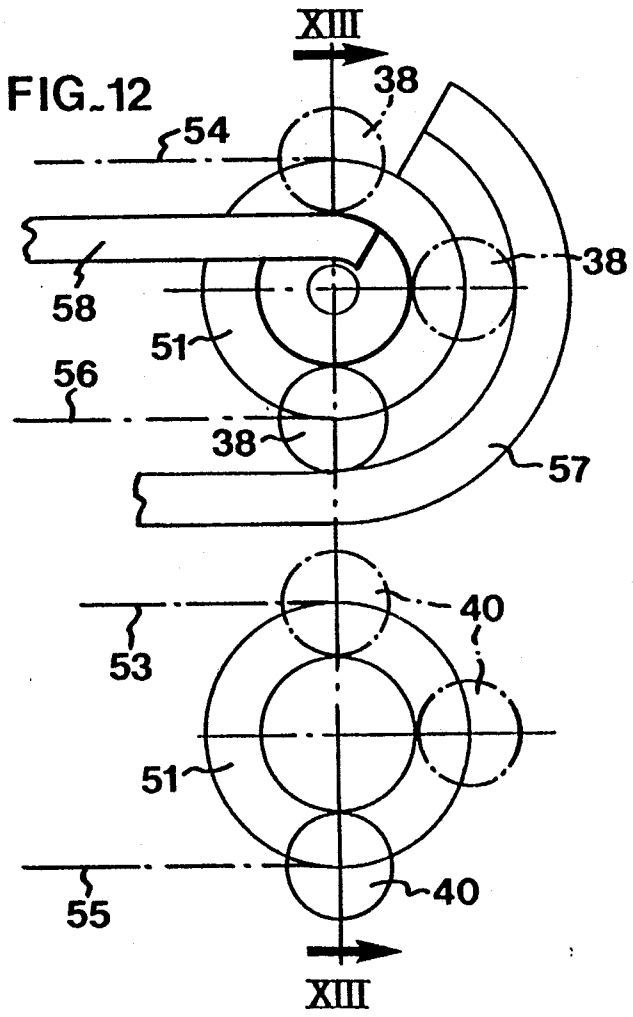

The invention will now be described in more detail with reference to the accompanying drawings in which three embodiments of the inventive device are illustrated and in which:

FIG. 1 is a perspective view of one embodiment of a load-handling device according to the invention, FIG. 2 is a side view of the device in FIG. 1, seen from the front with respect to FIG. 1, FIG. 3 is a top plan view of the same device, FIG. 4 is a perspective view of parts of the device according to the embodiment in FIGS. 1–3, FIG. 5 illustrates the path of motions of the load-engaging member in the device according to FIGS. 1–5, FIG. 6 illustrates on a larger scale a detail of the device in FIGS. 1–5, FIG. 7 is a schematic perspective view, conforming to FIG. 4, of a further embodiment of the inventive device, FIG. 8 shows an example of the use of the inventive load-handling device, designed as a automatic lifting truck, FIG. 9 is a schematic side view of a third embodiment of the device according to the invention, the load-engaging member being in one of its retracted positions, FIG. 10 is the same side view as FIG. 9, the load-engaging member being, however, in an extended position, FIG. 11 is the same view as FIG. 9, but the load-engaging member being in its retracted, load-carrying position, FIG. 12 illustrates on a larger scale the part of the embodiment according to FIGS. 9–11, which is the right-hand part in respect of FIG. 10, and FIG. 13 is a sectional view along the line XIII—XIII in FIG. 12.

FIG. 8 shows a warehouse space with an automatic load-handling system in which load-handling devices according to the present invention can advantageously be used. In the warehouse space there are a number of pallets 10 at predetermined locations in rows with intermediate passages 11. In the passages, a conductor system 12 is laid in the floor and serves as control loop for the load-handling devices 20. The control loop 12 is connected to a computer system 13 which controls the various functions of the load-handling devices 20 and the movements thereof along the control loops so that the pallets can be passed from the warehouse space to a number of stations 14 for depositing and picking up pallets. The system also includes communication points 15 at which communication is-effected between the computer system 13 and the individual load-handling devices 20, for transmitting instructions to the electronic control means of the load-handling devices. As illustrated in FIG. 8, the passages between the individual rows of pallets are quite narrow and essentially have the width of only one pallet length. This is rendered possible in that the load-handling devices are designed according to the present invention and in the manner described above and defined in more detail below.

FIG. 1 illustrates a first embodiment of a load-handling device 20 according to the invention. The load-handling device comprises a carriage 21 with a driving wheel 22 connected to a drive and control mechanism 23. Besides the carriage comprises two wheels 24 which are mounted on positionally fixed parallel axles. The fourth wheel 25 of the carriage is a castor wheel for guiding and pivoting the carriage. The body of the carriage includes a set of batteries 26 and electronic control means 27.

The carriage 21 comprises a frame which in the embodiment shown is U-shaped in order to accommodate the load-engaging member 28 included in the load-handling assembly. This member comprises forks 29 attached to a transverse plate 30. The transverse plate 30 is connected to a driving mechanism comprising a motor 31 having a drive shaft 32 which supports two sprockets 33. The sprockets 33 serve as guide rollers for chains 34 which at their other end run over a sprocket 35 which is rotatably but stationarily mounted on the carriage 21. The chain 34 thus forms endless driving elements travelling along a path which in this case comprises two parallel straight lines with intermediate semicircular portions. If a different motion of the mechanism is desired, the path can be designed in some other manner by using a different arrangement of the endless driving element. Between the tail or end wheels 33, 35 the path could thus be arched or formed in some other fashion.

Figure 5:
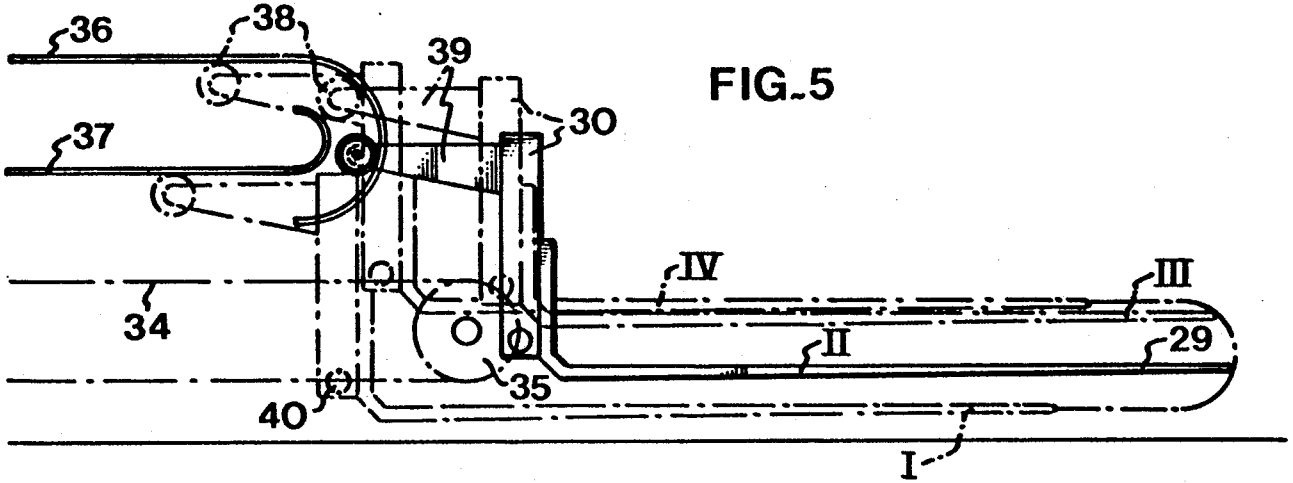

The drive system also includes guide tracks 36, 37 and a cam roller 38. The cam roller 38 is mounted on an arm 39 connected to the transverse plate 30. This arm 39 and the forks 29 project in opposite directions from the transverse plate 30. At the lower edge of the transverse plate 30 there is a pivot pin 40 which is connected to a connecting member 41 fitted with two projecting pins 42. These pins are inserted in tubular cross members 43 of a connecting link 44. At the opposite end of the transverse plate 30 there is an identical arrangement. In the structure, the pivot pin 40 thus forms the fulcrum of the double-armed lever which is formed by the forks 29 and the arms 39. When the connecting link is positioned along the lower part of the path of the chain 34, the forks 29 are in their lower position. The setting position I indicated by dash-dot lines in FIG. 5 illustrates how the forks move forwards in under a pallet. When the connecting link 44 reaches a position illustrated by full lines II, the forks have begun to move upwards and engage the pallet so as to move upwards and then backwards while continuing to move through the positions III and IV. When the connecting link 44 has moved along its semi-circular path upwards round the sprocket 35, the movement passes into a retracting movement in which the forks and their load are retracted into the space between the legs of the U-shaped body. When the link 34 has reached the second guiding wheel 33, the motor 31 is stopped. Subsequently the carriage can be moved to any desired position. When the load is to be discharged, the motor is started for rotation in the opposite direction, whereby the movements described will occur in the opposite direction. When the pallet has been deposited, the forks 29 are withdrawn by continued operation of the motor, until the connecting link 44 has moved along the lower part of the path back to the sprocket 33. In the embodiment shown in FIGS. 1–6, the transverse plate 30 is directed upwards in relation to the forks 29. If desired, and if the pallets are designed differently, the arrangement can be turned upside-down so that the transverse plate is directed downwards. Other arrangements are also feasible, although not equally preferred.

FIG. 7 illustrates such a possible variant of the device according to the invention. In this case, the forks 29' and arms 39' are arranged in substantially the same plane. The height of the transverse plate 30' is exceedingly small and is formed with a U-shaped recess 45 which suffices for the chain 34 and its links to pass through this space through which the pivot pin 40 and the connecting member also pass. The arm 39' then projects beyond the other side of the chain and its end is fitted with a cam roller 38'. Like in the embodiment described above, the cam roller 38' engages the guides 36', 37'. Such an arrangement allows a lower overall height but suffers from the drawback that the surface pressure between the cam roller 38' and the guides 36', 37' is higher than in the other embodiment, when the forks take the position shown in FIG. 7.

The embodiment in FIGS. 9–13 distinguishes from the embodiments described above mainly with respect to the arrangement of the endless driving element 34, preferably the chain. Thus, the driving element runs along a path of different shape, substantially the shape of a lying U. In this case, the path comprises four parallel straight lines with intermediate semi-circular portions. To this end, use is made of five guiding wheels 50–52. The guiding wheels 51 correspond to the guiding wheels 35 in the embodiments described above. The guiding wheel 50 corresponds to the guiding wheel 33 and is connected to a motor (not shown) for driving the device. The guiding wheels 52 are positioned on the same side of the carriage as the guiding wheel 50. By guiding the chain or the endless driving element 34 in this manner, there are provided two upper runs 53, 54 travelling in the same direction, and two lower runs 55, 56 traveling in the same direction.

Like in the embodiments described above, the load-engaging member 29, 30 is, in the transition between its two arms 29, 30, rotatably connected (by means of the pivot pin 40) to the endless driving element 34 so as to follow the movements thereof. Similarly, the other arm 30 of the load-engaging member is provided with a cam follower 38 which has the shape of a rotatably mounted roller and which, for the purpose of absorbing torque, is arranged to cooperate with and abut against a cam track 57, 58 included in the load-handling assembly. The cam track is differently designed as compared to the previous embodiments and comprises a lower cam track 57 and an upper cam track 58, the lower cam track 57 at its outer end being bent in conformity with the upper and also the lower cam track in the embodiments described above. Thus, the lower cam track 57 serves to absorb torque, when the load-engaging member 29 has taken its lower retracted position and when it moves upwards to be transferred to its upper retracted position. The upper cam track 58 serves to absorb torque, when the load-engaging member moves along the two upper runs 53, 54 of the endless driving element.

In contrast to the embodiments described above, the other arm 30 of the load-engaging member is also rotatably connected to the endless driving element 34 so as to follow the movements thereof. In this case, too, the arm is connected to a link of the endless driving element, when this is designed as a chain.

FIGS. 12 and 13 illustrate on a larger scale how the connecting operation is carried out. For this purpose, use is made of links 44 which are specially designed and support a pin which is rotatably connected to the arm 30 of the load-engaging member. FIG. 13 also shows that the cam follower 38 can be designed as a roller 38 which is slipped onto the pin by which the link 44 is connected to the arm 30. In FIG. 13, the cam roller 38 is indicated by dash-dot lines, as it runs along the upper guide or cam track 58.

In the device according to the invention, it is also possible to use an endless driving element other than the chain 34. The driving element thus could also be a belt which travels over guide rollers. The belt can be designed as a toothed belt but can also be an ordinary, flat driving belt having a pin which is attached by vulcanisation or in some other manner and corresponds to the pivot pin 40 in the embodiments according to FIGS. 1–13.

In the embodiments illustrated, the load is permanently supported by the forks 29. In a further embodiment of the invention (not shown), the body of the carriage can be designed in such a manner that the load is placed on a stationary load support in order to stand stably on the carriage, as the carriage moves over the floor.

In the embodiments illustrated, use is made of forks having load-engaging members. Within the scope of the invention, it is also possible to utilise gripping means which are pivotably attached to the transverse plate 30 in order to laterally engage the goods, e.g. an upright roll of paper.

We claim:

1. A load-handling device comprising a carriage (21) adapted for movement on a floor, and a load-handling assembly arranged on said carriage and including a cam track, a driving mechanism and a load-engaging member (29) which is driven by said driving mechanism and is vertically movable as well as extendable and retractable relative to said carriage, said driving mechanism of said load-handling assembly comprising a first endless driving element (34) which is adapted for movement along a path between spaced-apart guides (33, 35) and a driving member for driving said driving element, said load-engaging member (29) of said load-handling assembly including a first and a second arm designed as a double-armed lever (29, 30, 39) with a fulcrum (40) that is rotatably connected to the first endless driving element (34) so as to follow the movement thereof, and said first arm (29) constitutes at least a portion of the load-engaging member (29), and said second arm (30) has a cam follower member (38) which, for the purpose of absorbing torque, is arranged to cooperate with and abut against said cam track (36, 37) included in the load-handling assembly.

2. Device as claimed in claim 1, wherein the first endless driving element (34) is passed in U-shape over the spaced-apart guides (50–52), with two upper runs (53–54) travelling in a common direction and two lower runs (55–56) travelling in a common direction, and that said second arm (30) as well, or its cam follower (38), is rotatably connected to the first endless driving element so as to follow the movement thereof.

3. Device as claimed in claim 2 wherein the path of said first endless driving element has a defined shape and said cam track (36, 37) is of substantially the same shape as at least a portion of the path of the first endless driving element (34).

4. Device as claimed in claim 2, wherein said driving mechanism further comprises a second endless driving element which extends parallel to said first endless driving element and is spaced from said first endless driving element, said second endless driving element being driven by said driving member, said device further comprising a second cam track, said second arm comprising a second cam follower member, said second cam follower member being dimensioned and arranged for contact with said second cam track such that said second cam track provides a torque absorbing function.

5. Device as claimed in claim 2, wherein said guides (33, 35) are chain wheels and said first endless driving element (34) is a chain having a chain link (44), said double-armed lever including a pivot pin (40) forming the fulcrum of the double-armed lever (29, 30, 39), and said pivot pin being connected to said chain link.

6. Device as claimed in claim 2, wherein said driving member includes a driving motor (31), and said driving motor being dimensioned and arranged for driving said first endless driving element and for lifting and lowering as well as extending and retracting said load-handling assembly.

7. Device as claimed in claim 2, wherein said carriage (21) is designed as a self-propelling carriage with electronic control means (27) communicating with a computer system (13).

8. Device as claimed in claim 1 wherein the path of said first endless driving element has a defined shape and said cam track (36, 37) is of substantially the same shape as at least a portion of the path of the first endless driving element (34).

9. Device as claimed in claim 8, wherein said driving mechanism further comprises a second endless driving element which extends parallel to said first endless driving element and is spaced from said first endless driving element, said second endless driving element being driven by said driving member, said device further comprising a second cam track, said second arm comprising a second cam follower member, said second cam follower member being dimensioned and arranged for contact with said second cam track such that said second cam track provides a torque absorbing function.

10. Device as claimed in claim 8, wherein said guides (33, 35) are chain wheels and said first endless driving element (34) is a chain having a chain link (44), said double-armed lever including a pivot pin (40) forming the fulcrum of the double-armed lever (29, 30, 39), and said pivot pin being connected to said chain link.

11. Device as claimed in claim 8, wherein said driving member includes a driving motor (31), and said driving member includes a driving motor being dimensioned and arranged for driving said first endless driving element and for lifting and lowering as well as extending and retracting said load-handling assembly.

12. Device as claimed in claim 8, wherein said carriage (21) is designed as a self-propelling carriage with electronic control means (27) communicating with a computer system (13).

13. Device as claimed in claim 1, wherein said guides (33, 35) are chain wheels and said first endless driving element (34) is a chain having a chain link (44), said double-armed lever including a pivot pin (40) forming the fulcrum of the double-armed lever (29, 30, 39), and said pivot pin being connected to said chain link.

14. Device as claimed in claim 1, wherein said driving member includes a driving motor (31), and said driving motor being dimensioned and arranged for driving said first endless driving element and for lifting and lowering as well as extending and retracting said load-handling assembly.

15. Device as claimed in claim 1, wherein said driving member includes a driving motor (31), and said driving motor being dimensioned and arranged for driving said first endless driving element and for lifting and lowering as well as extending and retracting said load-handling assembly.

16. Device as claimed in claim 1, wherein said carriage (21) is designed as a self-propelling carriage with electronic control means (27) communicating with a computer system (13).

17. Device as claimed in claim 1, wherein said driving mechanism further comprises a second endless driving element which extends parallel to said first endless driving element and is spaced from said first endless driving element, said second endless driving element being driven by said driving member, said device further comprising a second cam track, said second arm comprising a second cam follower member, said second cam follower member being dimensioned and arranged for contact with said second cam track such that said second cam track provides a torque absorbing function.

18. Device as claimed in claim 17, wherein said guides (33, 35) are chain wheels and said first endless driving element (34) is a chain having a chain link (44), said double-armed lever including a pivot pin (40) forming the fulcrum of the double-armed lever (29, 30, 39), and said pivot pin being connected to said chain link.

19. Device as claimed in claim 17, wherein said driving member includes a driving motor (31), and said driving motor being dimensioned and arranged for driving said first endless driving element and for lifting and lowering as well as extending and retracting said load-handling assembly.

20. Device as claimed in claim 17, wherein said carriage (21) is designed as a self-propelling carriage with electronic control means (27) communicating with a computer system (13).

* * * * *